US006109580A

United States Patent [19]

Stern et al.

[11] Patent Number: 6,109,580

[45] Date of Patent: Aug. 29, 2000

[54] FOOD AND BEVERAGE TRAY SUPPORTABLE BY A CUP HOLDER

[76] Inventors: Jon L. Stern, 6 Underhill, Mill Valley, Calif. 94941; Keith A. Hippely, 514 Harkness St., Manhattan Beach, Calif. 90260

[21] Appl. No.: 09/122,536

[22] Filed: Jul. 24, 1998

[51] Int. Cl.[7] ..... A47K 1/08; A47F 5/00

[52] U.S. Cl. ..... 248/311.2; 248/315

[58] Field of Search ..... 248/311.2, 315, 248/318, 210

[56] References Cited

U.S. PATENT DOCUMENTS 5,118,063 6/1992 Young ..... 248/311.2

5,651,523 7/1997 Bridges ..... 248/311.2

5,702,041 12/1997 Sun et al. ..... 224/539

*Primary Examiner*—Ramon O. Ramirez

*Assistant Examiner*—Jerome A. DeLuca

*Attorney, Agent, or Firm*—Roy A. Ekstrand

[57] ABSTRACT

A tray body preferably fabricated of a molded plastic material defines a generally rectangular recess having at least one support member extending downwardly therefrom. The tray body further defines a center cup receptacle having a receptacle wall extending downwardly beyond the tray body. A pair of side cup receptacles are formed on opposed sides of the center cup receptacle. In one embodiment, additional support members extend downwardly from the side cup receptacles. In an alternate embodiment, a pair of spaced apart support members are formed in the recess in place of the cup receptacle supports.

24 Claims, 3 Drawing Sheets

FOOD AND BEVERAGE TRAY SUPPORTABLE BY A CUP HOLDER

FIELD OF THE INVENTION

This invention relates generally to food and beverage or so-called "concession trays" used in various sports and entertainment facilities and particularly to apparatus used in combination with the standard cup holder receptacle supporting armrest structures found therein.

BACKGROUND OF THE INVENTION

Most modern theaters and sports facilities such as arenas or stadiums provide an armrest between adjacent seats which, in addition to functioning as a standard armrest, supports a cup holding receptacle for user convenience. While such receptacles vary somewhat in design, all typically are configured to receive a slightly tapered beverage cup within a circular cross-section cup receptacle. For example, U.S. Pat. No. 4,863,134 issued to Young, et al. sets forth a COMBINATION CUP HOLDER AND ARMREST in which the cup holder is generally circular in cross-section and is integrally formed with the armrest. The armrest is secured to the upper surface of the seating structure between adjacent seats.

Such cup holders have, for the most part, provided satisfactory service in allowing the spectator or theater goer to securely place a single cup therein. Unfortunately, however, such cup holder armrest combinations have been shown to be somewhat limited in providing additional support space for other concession items such as those typically provided at sporting events or theaters. It is not unusual for the typical consumer or theater goer to purchase beverages along with food items such as popcorn, hot-dogs, candy or the like. In addition, the user or spectator is likely to be carrying a number of other items such as napkins or the like. The need for persons seated in such areas to accommodate these varied items has prompted practitioners in the art to provide a variety of devices and trays for food and beverage carrying and support. One such device is set forth in U.S. Pat. No. 5,118,063 issued to Young, Sr. which sets forth a CONCESSION TRAY for carrying beverages and snacks from a concession sales area to a stadium or theater seat. The tray includes a planar support area and a trio of cup receptacles at the forward end thereof each forming a downwardly extending generally frusto-conical element. The elements define respective receptacles for receiving beverage cups and are each generally configured to be receivable within the armrest receptacle of the stadium or theater seat. A balancing support member is secured to the underside of the planar tray portion to allow the entire device to rest in a stable manner upon a counter top or the like. The concession tray is positionable at various angles with respect to the armrest by selecting one of the three cup receptacles for insertion within the armrest receptacle. The concession tray is also pivotable with respect to the armrest through a range determined by the selected one of the cup receptacles used for support within the armrest receptacle. In related areas of the prior art, a variety of other tray devices have been provided. For example, U.S. Pat. No. 4,798,413 issued to Capelli sets forth a TRAY DEVICE which may be secured to or removed from a supporting arm piece of a furniture article such as a lawn chair. A snap-fit swivel arrangement is provided for pivotally securing the tray to the armrest.

U.S. Pat. No. 3,186,673 issued to Olson sets forth a DETACHABLE TRAY AND TRAY HOLDER having a generally planar tray supported by a removable attachment.

The removable attachment includes a bracket securable to a chair armrest by a pair of juxtaposed coil springs. The armrest is forced between the springs to provide a removable attachment of the bracket.

U.S. Pat. No. 3,675,969 issued to Gage sets forth a CHAIR-ARM CUP RECEPTACLE for attachment to the end of the arm of a chair. A cup is cantilevered beyond the end of the chair-arm from a mounting bracket on the end thereof.

U.S. Pat. No. 3,955,672 issued to Brundage sets forth a PLATE ASSEMBLY having a body and cup support member integrally formed therewith. The body is provided with a channel which functions to receive the forearm of the user for support of the plate assembly. The cup support member protrudes into the interior of the channel and functions to provide balancing of the plate when positioned upon the user's forearm.

A variety of early combination tray and beverage or cup holders are shown in U.S. Pat. No. 3,162,344 issued to Sabol for a BOTTLE TRAY; U.S. Pat. No. 1,544,972 issued to Gebelein for a PLATE; U.S. Pat. No. 1,757,689 issued to Strickland for a COMBINATION CUP AND CONE HOLDER; U.S. Pat. No. 2,801,066 issued to Clare for DISPLAY STANDS; U.S. Pat. No. 3,498,470 issued to Thomas for a SERVING TRAY WITH INTEGRAL CUP HOLDER and Canadian Patent 968761 issued to Graf for a BUFFET TRAY.

Still other generally related prior art devices have been provided for use in combination with outdoor furniture or the like. Examples of such apparatus are found in U.S. Pat. No. 4,003,598 issued to Glaze for a CHAIR MOUNTED TRAY; U.S. Pat. No. 4,591,206 issued to Pribble for a TABLE ATTACHMENT FOR CHAIRS and U.S. Pat. No. 4,575,149 issued to Forestal, et al. for an ATTACHABLE HOUSEHOLD SERVICE TRAY DEVICE FOR FURNITURE.

While the foregoing described prior art devices have, to some extent, enjoyed commercial success and provided some improvement in the art, they have also been subject to several problems and limitations. For example, many of the prior art food and beverage trays are confining and intrusive for the user when secured to an armrest or armrest cup holder. One critical problem exhibited by the tray shown in U.S. Pat. No. 5,118,063, described above, arises from the use of a trio of beverage cup receptacles which extend into the user's lap when in use. The extension of the cup receptacles brings the receptacle bottoms close to the user's lap. This is confining to the user and raises the risk of accident or mishap as the user's legs contact the cup receptacle bottoms. As a result, there remains nonetheless a continuing need in the art for evermore improved, efficient and useful food and beverage trays for use in such stadium and theater facilities.

SUMMARY OF THE INVENTION

Accordingly, it is a general object of the present invention to provide an improved food and beverage tray supportable by a cup holding armrest in a theater, sports arena or stadium or the like. It is a more particular object of the present invention to provide an improved food and beverage tray which is supportable within an armrest cup receptacle in a manner facilitating a greater variety of angular positions and relationships with respect to the supporting armrest. It is a still further object of the present invention to provide an improved food and beverage tray supportable by an armrest cup receptacle which avoids the need for removing and reattaching the food and beverage tray to adjust its angular position through its full range of variation.

In accordance with the present invention, there is provided a food and beverage tray alternatively supportable on an armrest cup holder or a flat surface, the food and beverage tray comprising: a tray body defining a lower edge and a recess, for food concession articles or the like, having a bottom surface; a center cup receptacle, formed in the tray body forward of the recess, having a downwardly extending cup receptacle wall, the cup receptacle wall extending beyond the bottom edge and being configured for insertion into an armrest cup holder; and a pair of side cup receptacles formed in the tray body adjacent the center cup receptacle, each of the side cup receptacles having a cup supporting bottom extending downwardly a distance equal to or less than the bottom edge.

In another sense, the present invention provides a food and beverage tray alternatively supportable by an armrest cup holder or upon a flat surface comprising: a tray body defining a lower edge and a recess, the recess having a bottom surface; a center cup receptacle, formed in the tray body forward of the recess, having a downwardly extending cup receptacle wall, the downwardly extending cup receptacle wall extending beyond the lower edge and being configured to be received within an armrest cup holder to pivotally support the food and beverage tray upon the armrest; at least one side cup receptacle, formed in the tray body forward of the recess and offset from the center cup receptacle, the at least one side cup receptacle having a sidewall and bottom extending downwardly a distance equal to or less than the lower edge; and a plurality of downwardly extending supports formed in the tray body and extending downwardly beyond the lower edge to a distance substantially equal to the cup receptacle wall to provide support for the food and beverage tray upon a flat surface.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
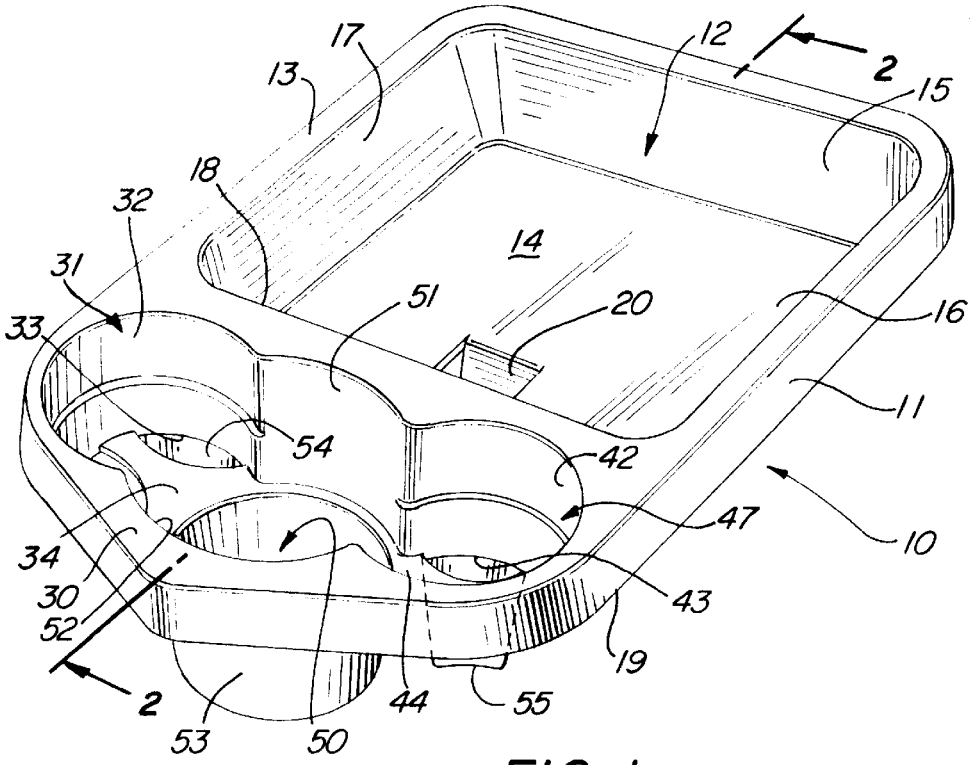
FIG. 1 sets forth a perspective view of a food and beverage tray constructed in accordance with the present invention.

FIG. 1 sets forth a perspective view of a food and beverage tray constructed in accordance with the present invention and generally referenced by numeral 10. In its preferred fabrication, tray 10 is formed as an integral one-piece molded plastic unit which, as is described below in greater detail, is capable of nesting or stacking in a nesting manner with a plurality of similarly configured and formed food and beverage trays. Alternatively, however, it is recognized that tray 10 may be fabricated of other materials such as composite particle material, paper pulp material, or other formible particulate material such as wood flour or starch pulp molding materials.

Tray 10 is fabricated having a tray body 11 which defines a recess 12 having a bottom surface 14, a rear sidewall 15, a right sidewall 16, a left sidewall 17 and a front wall 18. Body 11 further includes a rim 13 encircling recess 12 and extending forwardly therefrom to encircle a plurality of cup receptacles 31, 41 and 50. Receptacle 50 forms a center cup receptacle having a downwardly extending cup receptacle wall 53, a rear wall 51 and a front wall 52. Beverage cup receptacle 31 defines a partially cylindrical sidewall 32 having a bottom edge 33 and a bottom support 34 formed therein. Similarly, a beverage cup receptacle 41 includes a generally cylindrical wall 42 having a bottom edge 43 formed thereon. A bottom surface 44 extends across lower edge 43 of receptacle 41. Cup receptacles 31 and 41 define respective downwardly extending supports 54 and 55. While not clearly seen in the perspective view of FIG. 1, it will be understood that support 54 is substantially identical to support 55, both of which extend downwardly to the same downward extent as cup receptacle wall 53.

Figure 2:
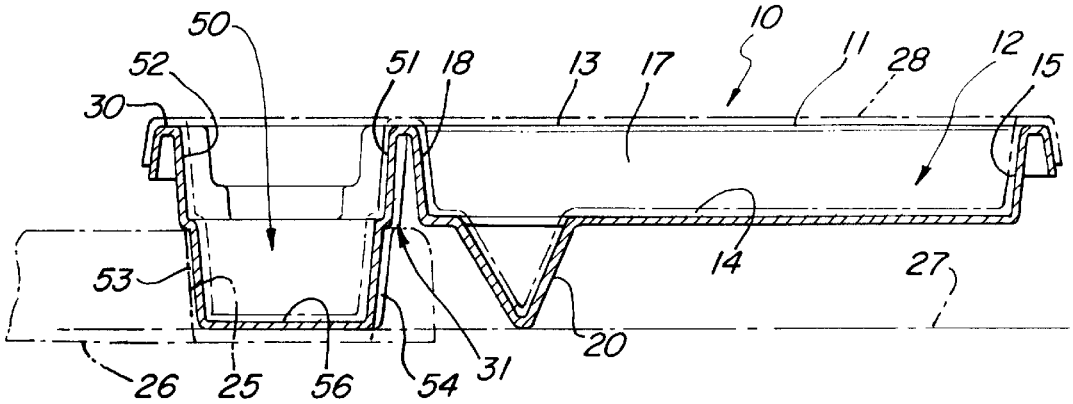
FIG. 2 sets forth a section view of the present invention food and beverage tray taken along section lines 2—2 in FIG. 1.

A triangularly shaped downwardly extending support member 20 is formed within bottom surface 14 of recess 12 and, as is better seen in FIG. 2, is operative in cooperation with supports 54 and 55 to facilitate the stable placement of food and beverage tray 10 upon a typical flat working surface such as a countertop or the like.

Figure 3:
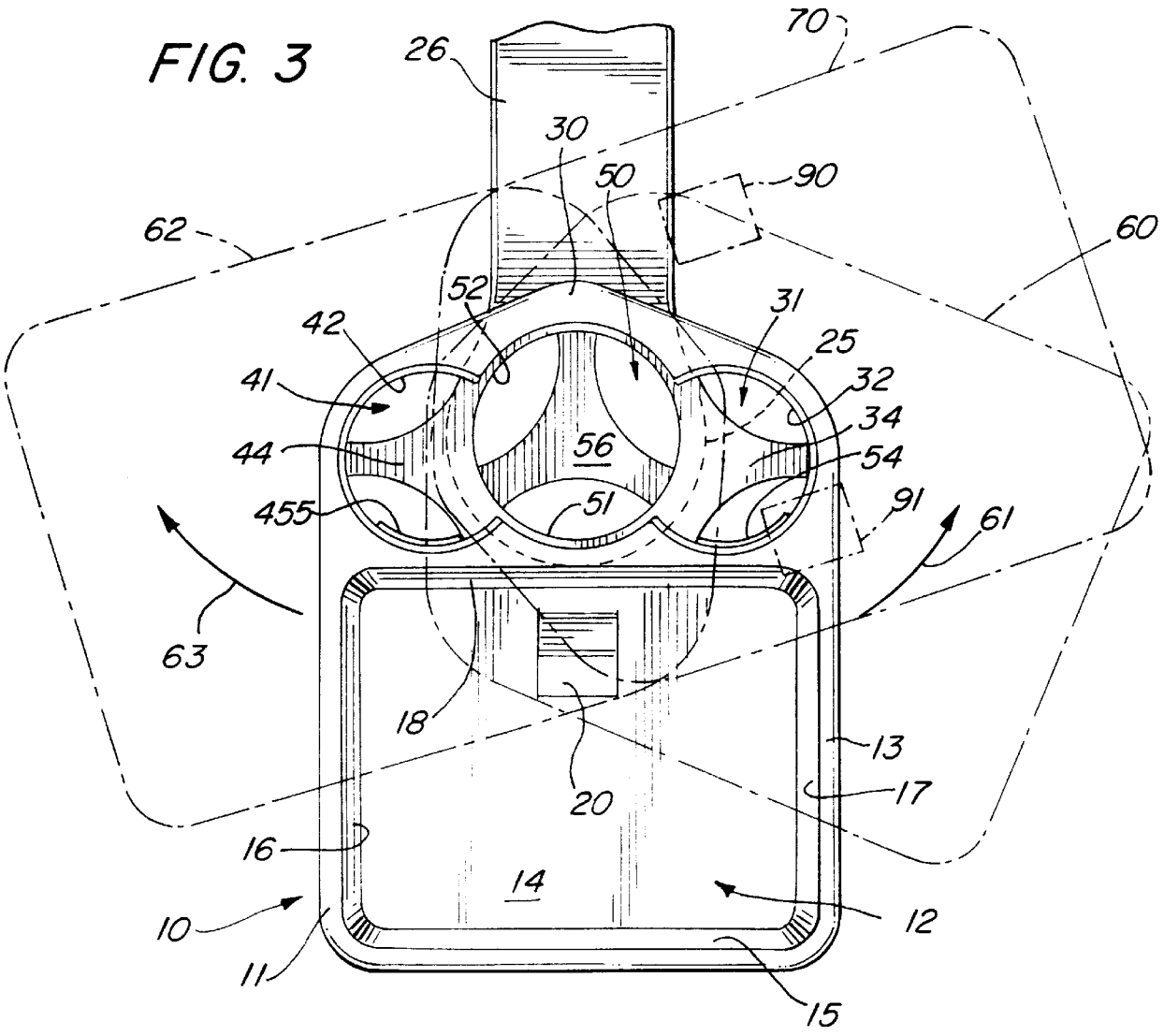
FIG. 3 sets forth a top view of the present invention food and beverage tray supported upon a typical armrest and cup holder depicting alternative angular positions of the tray.

Thus, in it anticipated use, food and beverage tray 10 accommodates a plurality of beverage cups within receptacles 31, 41 and 50 together with various additional articles such as other food items within recess 12 resting upon bottom surface 14. In the anticipated use of the present invention food and beverage tray and as is shown below in FIGS. 2 and 3, tray 10 is received within a typical armrest cup receptacle by inserting cup receptacle wall 53 therein. When supported in this manner upon a typical cup holder armrest combination, tray 10 is pivotally movable within the cup holder of the armrest to various angular positions as illustrated in FIG. 3. In accordance with an important aspect of the present invention, it will be noted that beverage cup receptacles 31 and 41 are substantially more shallow than center cup receptacle 50. This facilitates the side to side pivotal movement of food and beverage tray 10 illustrated in FIG. 3 to a substantially greater angular range than that which is provided by the above-described prior art devices such as the device shown in U.S. Pat. No. 5,118,063. In prior art devices such as the device shown in the '063 patent, the downward extension of all three beverage receptacles greatly limits the angular positioning of the food and beverage tray upon a typical armrest. In addition and in accordance with a further advantage of the present invention, the positions of supporting elements such as supports 54 and 55 as well as support member 20 are maintained in a substantially close relationship to center cup receptacle 50. This configuration provides stable use of the present invention food and beverage tray upon a counter top surface or the like while simultaneously avoiding the undesired downward extension of tray elements into the lap of the user when the tray is positioned above the user's lap. It has been found that prior art trays such as the above-referenced prior art device shown in the '063 patent have an undesirable tendency to intrude upon the user's lap in a typical seating environment when the tray is positioned in a sideways orientation due to the downward extension of the side cup receptacles on either side of the center cup receptacle. Thus, with temporary reference to FIG. 3, it will be noted that tray 10, shown in FIGS. 1, 2 and 3 is capable of a variety of angular positions extending between dashed-line representation 60 illustrating pivotal movement of tray 10 in the direction of arrow 61 and the opposite angular position indicated by dashed-line representation 62 resulting from pivoting in the direction indicated by arrow 63. It will be further apparent with continued temporary reference to FIG. 3 that support member 20 of tray 10 as well as supports 54 and 55 maintain a close position to the supporting armrest throughout the entire pivotal range of motion. As mentioned above, this avoids undesired intrusion of the tray support members onto the user's lap in a typical seating environment. In addition, the present invention tray takes up less space than prior art devices and thereby allows the user to leave the seat and return to the seat without the need to remove the tray from the cupholder. In accordance with a further advantage of the present invention, cup receptacle 50 defines an enlarged upper portion which allows the support of a cup of greater diameter than cupholder 25.

FIG. 2 sets forth a section view of the present invention tray taken along section lines 2—2 in FIG. 1. For purposes of convenience, tray 10 is shown in FIG. 2 received within a typical cup holder 25 of the type found in conventional armrest/cup holder units of many theaters, stadiums, arenas and the like. In addition, it will be apparent to those skilled in the art that the present invention tray is equally applicable to conventional rear-facing cupholder apparatus usually fitted between adjacent seatbacks. Also shown in FIG. 2 is a dashed-line illustration 27 of a planar support surface such as a counter top or the like to illustrate the self-supporting character of the present invention food and beverage tray when placed thereon. It will be understood that surface 27 and armrest 26 with cup holder receptacle 25 are combined in FIG. 2 solely for convenience and that each is, of course, separately utilized within a typical theater, arena or stadium food concession environment.

FIG. 2 also shows an important aspect of the present invention food and beverage tray which facilitates the nesting or vertical stacking of a plurality of identical trays. Thus, FIG. 2 shows tray 10 in full section together with a dashed-line representation 28 of an identical tray fitted upon tray 10 in a nesting arrangement. Of importance in examining dashed-line representation 28 is its conformity to tray 10 which allows the nesting and stacking arrangement. It will be apparent to those skilled in the art that a plurality of trays identical to tray 10 may therefore be vertically stacked in a space-saving stable nested arrangement.

More specifically with reference to FIG. 2, tray 10 includes a tray body 11 defining a recess 12 surrounded by downwardly extending walls such as walls 15, 17 and 18 to support a generally planar bottom surface 14. Body 11 further defines a rim 13 encircling recess 12 and extending forwardly to encircle a plurality of cup receptacles as is better seen in FIG. 1. A front rim 30 forms the forward portion of encircling rim 13. Body 11 further defines a triangularly shaped downwardly extending support member 20. Tray 10 further includes a center cup receptacle 50 having a downwardly extending somewhat tapered receptacle wall 53. Center receptacle 50 further defines a front wall 52 and a rear wall 51. A cup receptacle 31 (better seen in FIG. 1) includes a downwardly extending support 54. In accordance with an important aspect of the present invention, it will be noted that receptacle wall 53, support 54 and support member 20 have substantially coplanar bottom edges. While not shown in FIG. 2 due to the section view taken therein, it will be understood that support 55 (seen in FIG. 1) extending downwardly from receptacle 41 is similar to support 54 and similarly coextensive in accordance with this coplanar arrangement of supports. As a result, tray 10 is stable when rested upon a planar surface indicated by dashed line surface 27 which may, for example, be a typical working counter or the like in a food concession environment.

In further accordance with the anticipated use of the present invention food and beverage tray, a conventional armrest 26 having a conventional cup holder 25 is shown in dashed-line representation to illustrate the support of tray 10 therein. In accordance with this anticipated use, tray 10 is pivotally supported upon armrest 26 by inserting receptacle wall 53 of center cup receptacle 50 into cup holder 25 of armrest 26. In this arrangement, the entire support for tray 10 is provided by the insertion of receptacle wall 53 within cup holder 25. This allows tray 10 to be pivoted with respect to armrest 26 by the user in the manner illustrated in FIG. 3. Of importance to note with respect to an important aspect of the present invention, it should be seen in FIG. 2 that support 54 (as well as support 55 seen in FIG. 1) are close to armrest 26 and cup holder 25 and, as a result, do not extend unduly into the seating environment or lap area of the user when tray 10 is used in its customary fashion. In further accordance with this important advantage, it will be noted that support member 20 is also positioned close to center cup receptacle 50 to also be minimally intrusive to the seating environment of the user when tray 10 is pivoted to overlie the user's lap in the manner indicated in FIG. 3. Thus, it will be apparent to those skilled in the art that the combination of receptacle wall 53, supports 54 and 55 and support member 20 cooperate to support tray 10 upon a flat surface in a stable manner while avoiding undue intrusion into the lap seating area of the user when the tray is pivoted to overlie the user's lap.

FIG. 3 sets forth a top view of tray 10 received upon armrest 26 in accordance with the illustration of FIG. 2 in which the pivotal movement for alternate positioning of tray 10 is illustrated in dashed-line. Thus, by way of overview, tray 10 is shown in solid-line representation upon armrest 26 and will be understood to be supported in the manner indicated in FIG. 2. In addition, tray 10 is shown in alternate pivotal positions indicated by dashed-line representations, 60 and 62 which result from pivoting tray 10 in the directions indicated by arrows 61 and 63 respectively.

More specifically, and as described above, tray 10 includes a body 11 defining a recess 12 surrounded by walls 15, 16, 17 and 18 and defining a bottom surface 14. As is also described above, bottom surface 14 of body 11 defines a downwardly extending triangular support member 20. An upper rim 13 encircles recess 12 and extends forwardly to encircle a plurality of cup receptacles 31, 41 and 50. Rim 13 forms a front rim 30 on either side of center receptacle 50. Center receptacle 50 defines a rear wall 51, a front wall 52 and a bottom 56. In the embodiment shown in FIG. 3, bottom 56 of receptacle 50 is a three-pronged web to facilitate drainage of liquids spilled within the cup receptacle.

Receptacle 31 defines a sidewall 32 and a bottom surface 34. Receptacle 31 further defines a downwardly extending support 54. Similarly, receptacle 41 defines a sidewall 42, a bottom 44 and a support 55.

In the use of tray 10 illustrated in FIG. 3, an armrest 26 having an integrally formed cup holder 25, which is of generally conventional fabrication, receives and supports tray 10 due to the insertion of cup receptacle wall 53 of cup holder 50 (shown in FIG. 2) in the above-described use of tray 10.

In accordance with the present invention, tray 10 may be pivoted about cup holder 25 in the direction indicated by arrow 61 to the dashed-line position shown as dashed-line 60 on one side or, alternatively, pivoted in the direction indicated by arrow 63 to the dashed-line position indicated by dashed-line 62. The degree of pivotal movement of tray 10 in either direction is limited solely by the contact of support 54 in the direction indicated by arrow 61 against armrest 26 or support 55 in the direction indicated by arrow 63 against armrest 26. Thus, as can be seen, substantial angular pivotal motion is readily available in utilizing tray 10 in the manner shown. It should also be noted that the close positioning of support member 20 maintains the downward extension of support member 20 in close proximity to armrest 26 and cup holder 25. In this manner, the intrusion into the seating areas which the user occupies on either side of armrest 26 is maintained at a minimum unlike prior art cup holders which extend a substantial distance into the seating area to overlie the user's lap and raise the potential for inadvertent jostling of the food and beverage tray.

Figure 4:
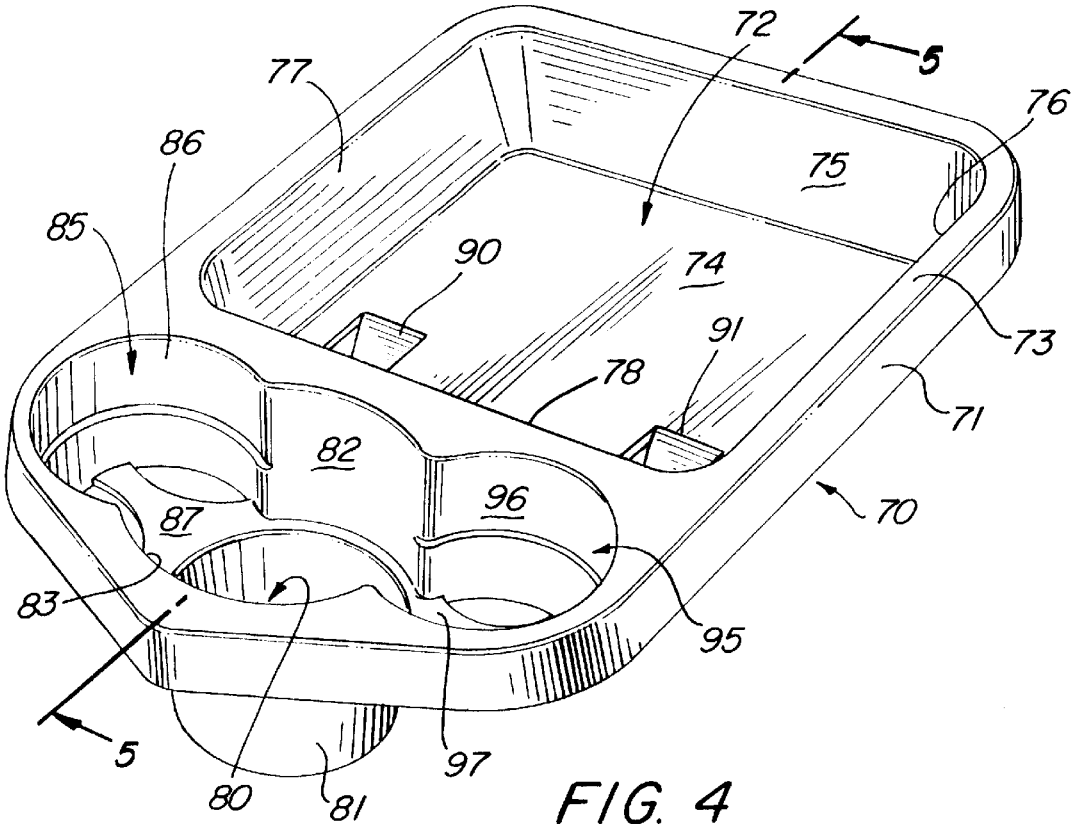
FIG. 4 sets forth a perspective view of an alternate embodiment of the present invention food and beverage tray.
Figure 5:
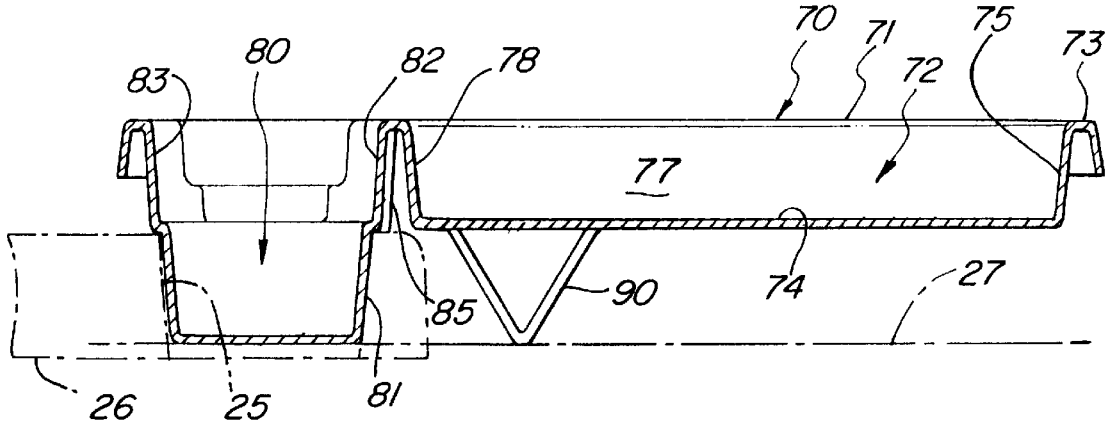
FIG. 5 sets forth a section view of the embodiment of the present invention food and beverage tray shown in FIG. 4 taken along section lines 5—5 therein.

FIG. 4 sets forth a perspective view of an alternate embodiment of the present invention food and beverage tray generally referenced by numeral 70. By way of overview, it will be apparent to those skilled in the art that tray 70 shown in FIGS. 4 and 5 is substantially identical to tray 10 shown in FIGS. 1 through 3 with the differences therebetween being found in the use of a pair of triangular supports 90 and 91 of tray 70 used in place of support member 20 of tray 10 and the omission of supports 54 and 55 from tray 70. In all other respects, however, tray 70 may be fabricated substantially in accord with tray 10 and its use and operation is substantially identical. The primary difference found in the use of tray 70 with respect to tray 10 is illustrated in FIG. 3 by the substantially greater pivotal motion of tray 70 with respect to armrest 26 which may be used due to the absence of supports 54 and 55 from tray 70.

More specifically and with reference to FIG. 4, tray 70 includes a body 71 defining an upper rim 73 and a recess 72. Recess 72 is bounded by walls 75, 76 and 77 and extends to a bottom surface 74. Bottom surface 74 defines a pair of spaced apart downwardly extending triangular support members 90 and 91 which replace support member 20 in tray 10 (seen in FIG. 1).

Tray 70 further includes a center cup receptacle 80 having a rear wall 82, a front wall 83 and a downwardly extending receptacle wall 81. Tray 70 further includes side receptacles 85 and 95 formed by sidewalls 86 and 96 and bottom surfaces 87 and 97 respectively. In the preferred fabrication of the invention, the bottom portions of side receptacles 85 and 95 extend downwardly a distance which is equal to or less than the downward extension of body 71. As mentioned above, the present invention food and beverage tray is fabricated to rest in a stable manner upon a flat surface such as a concession area counter top or the like. Tray 70 fulfills this objective by the three point support provided by support members 90 and 91 together with receptacle wall 81. Thus, with temporary reference to FIG. 5, it will be noted that tray 70 may be rested upon a flat surface such as dashed-line surface 27.

Returning to FIG. 4, it will be apparent to those skilled in the art by examining FIGS. 1 and 4 together that tray 70 is fabricated to provide for a nesting stacking arrangement in the same manner as described above for tray 10. Thus, tray 70 will be understood to be nestable and stackable with a plurality of food and beverage trays identical to tray 70 in the above-described manner. It will also be noted that support members 90 and 91 remain closely spaced to center cup receptacle 80 to minimize the intrusion of the support members into the seating area of the user when tray 70 is positioned overlying the user's lap in the manner indicated in FIG. 3.

FIG. 5 sets forth a section view of tray 70 taken along section lines 5—5 in FIG. 4. In similar fashion to FIG. 2, a conventional armrest 26 and cup holder 25 are shown in dashed-line representation. In further similarity to FIG. 2, an illustrative counter top surface or the like 27 is also shown in dashed-line representation to illustrate the stable support of tray 70 when rested upon a flat surface.

Tray 70 includes a body 71 defining a recess 72 having sidewalls 75, 77 and 78 together with a bottom surface 74. Body 71 further defines a lip 73 and a support member 90. Tray 70 further includes a center cup receptacle 80 having a rear wall 82, a front wall 83 and a cup receptacle wall 81. Tray 70 further includes a cup receptacle 85 adjacent receptacle 80.

As illustrated in FIG. 5, food and beverage tray 10 is receivable within a conventional cup holder supported by a conventional armrest as illustrated by cup holder 25 supported by armrest 26. When thus supported, tray 70 is pivotally secured within cup holder 25 by the insertion of cup receptacle wall 81. In accordance with an important advantage of tray 70, the degree of pivotal motion afforded by the use of a pair of offset support members 90 and 91 (seen in FIG. 4) together with the elimination of supports 54 and 55 shown on tray 10 in FIGS. 1 through 3, facilitates a substantially greater pivotal movement of tray 70 with respect to armrest 26.

Returning to FIG. 3 briefly, it will be noted that dashed-line representation 70 therein is pivoted a substantial amount with respect to armrest 26 before support 90 also shown in dashed-line representation comes into contact with armrest 26. As a result, tray 70 if pivotable to a greater degree affording the user a greater selection of angular positions for comfort, etc. It will be apparent that a similar extent of pivotal motion is achievable by tray 70 in the opposite direction limited by the position of support 91 and its contact with armrest 26.

Returning to FIG. 5, the support of tray 70 upon a flat surface indicated by dashed-line surface 27 is shown to be provided by support member 90 together with cup receptacle wall 81. While not seen in FIG. 5 due to the section view therein, it will be understood by those skilled in the art that support member 91 (seen in FIG. 4) is identical to support 90 and, as a result, forms the third support point upon surface 27 for tray 70 giving tray 70 a stable quality when rested upon such flat surfaces. It will be equally apparent to those skilled in the art by examination of FIG. 5 together with FIG. 2 that tray 70 is indeed nestable in the same manner as indicated for tray 10 allowing the space-saving nested stacking arrangement to be utilized by tray 70 as is illustrated for tray 10.

What has been shown is a food and beverage tray which may be fabricated as an integral molded unit which provides support for a trio of beverage cups together with various food articles. The food and beverage tray shown is advantageously fabricated to maintain the support members thereof in close proximity to the center receptacle which in turn minimizes the intrusion of the support elements of the tray into the seating environment of the user. The food and beverage tray shown is readily fabricated of low cost moldable materials and is fully nestable in a vertically stacked arrangement for convenient storage and transport.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A food and beverage tray alternatively supportable on an armrest cup holder or a flat surface, said food and beverage tray comprising:

a tray body defining a lower edge and a recess, for food concession articles or the like, said recess having a bottom surface and a plurality of downwardly extending support members;

a center cup receptacle, formed in said tray body forward of said recess, having a downwardly extending cup receptacle wall, said cup receptacle wall extending beyond said lower edge and being configured for insertion into an armrest cup holder; and a pair of side cup receptacles formed in said tray body adjacent said center cup receptacle, each of said side cup receptacles having a supporting bottom extending downwardly a distance equal to or less than said bottom edge whereby said cup supporting bottoms of said pair of side cup receptacles pass above an arm rest cup holder when said tray is pivoted about an armrest cup holder, said plurality of downwardly extending support members each defining a bottom portion which cooperates with said cup receptacle wall to support said food and beverage tray upon a flat surface.

2. The food and beverage tray set forth in claim 1 wherein each of said support members define a generally triangular member having its apex extending downwardly.

3. The food and beverage tray set forth in claim 2 wherein said tray body is configured to receiving a substantially identical tray body in a nested arrangement.

4. The food and beverage tray set forth in claim 3 wherein said support members are located upon said bottom surface in close proximity to said center cup receptacle.

5. The food and beverage tray set forth in claim 2 wherein said tray body is configured to receiving a substantially identical tray body in a nested arrangement.

6. The food and beverage tray set forth in claim 1 wherein said tray body is configured to receiving a substantially identical tray body in a nested arrangement.

7. The food and beverage tray set forth in claim 6 wherein said cup receptacle wall defines a receptacle bottom and wherein said plurality of supports includes a pair of support members each having a lower end and each extending downwardly from said bottom surface of said recess, said receptacle bottom and said lower ends of said pair of support members being coplanar.

8. The food and beverage tray set forth in claim 7 wherein said tray body is configured to receiving a substantially identical tray body in a nested arrangement.

9. The food and beverage tray set forth in claim 1 wherein said cup receptacle wall of said center cup receptacle defines a receptacle bottom and wherein said plurality of members includes a pair of support members each having a lower end and each extending downwardly from said bottom surface of said recess, said receptacle bottom and said lower ends of said pair of support members being coplanar.

10. The food and beverage tray set forth in claim 9 wherein said pair of support members each define a generally triangular shape having an apex extending downwardly.

11. The food and beverage tray set forth in claim 9 wherein said tray body is configured to receiving a substantially identical tray body in a nested arrangement.

12. The food and beverage tray set forth in claim 9 wherein said recess includes a front wall and wherein said pair of supports are located in close proximity to said front wall in a spaced-apart arrangement.

13. Food and beverage tray alternatively supportable by an armrest cup holder or upon a flat surface, said food and beverage tray comprising:

a tray body defining a lower edge and a recess, said recess having a bottom surface;

a center cup receptacle, formed in said tray body forwardly of said recess, having a downwardly extending cup receptacle wall, said downwardly extending cup receptacle wall extending beyond said lower edge and being configured to be received within an armrest cup holder to pivotally support said food and beverage tray upon said armrest;

at least one side cup receptacle, formed in said tray body forward of said recess and offset from said center cup receptacle, said at least one side cup receptacle having a sidewall and bottom portion extending downwardly a distance equal to or less than said lower edge; and a plurality of downwardly extending supports formed in said tray body and extending downwardly beyond said lower edge to a distance substantially equal to said cup receptacle wall to cooperate with said downwardly extending cup receptacle wall to provide support for said food and beverage tray upon a flat surface, said at least one side cup receptacle bottom portion remaining above said armrest when said tray is pivoted about said armrest cup.

14. The food and beverage tray set forth in claim 13 wherein said at least one side cup receptacle includes a pair of side cup receptacles each offset from said center cup receptacle.

15. The food and beverage tray set forth in claim 14 wherein said tray body is configured to receiving a substantially identical tray body in a nested arrangement.

16. A food and beverage tray alternatively supportable on an armrest cup holder or a flat surface, said food and beverage tray comprising:

a tray body defining a lower edge and a recess, for food concession articles or the like, said recess having a bottom surface and a support member extending downwardly form said bottom surface;

a center cup receptacle, formed in said tray body forward of said recess, having a downwardly extending cup receptacle wall, said cup receptacle wall extending beyond said lower edge and being configured for insertion into an armrest cup holder; and a pair of side cup receptacles formed in said tray body adjacent said center cup receptacle, each of said side cup receptacles having a supporting bottom extending downwardly a distance equal to or less than said bottom edge and a support extending downwardly from each of said side cup receptacles, said support member and said supports each defining a bottom portion which is coplanar to support said food and beverage tray upon a flat surface.

17. The food and beverage tray set forth in claim 16 wherein said tray body is configured to receiving a substantially identical tray body in a nested arrangement.

18. The food and beverage tray set forth in claim 16 wherein said support member is located upon said bottom surface in close proximity to said center cup receptacle.

19. The food and beverage tray set forth in claim 16 wherein said support member defines a generally triangular member having its apex extending downwardly.

20. The food and beverage tray set forth in claim 19 wherein said tray body is configured to receiving a substantially identical tray body in a nested arrangement.

21. The food and beverage tray set forth in claim 20 wherein said support member is located upon said bottom surface in close proximity to said center cup receptacle.

22. A food and beverage tray alternatively supportable by an armrest cup holder or upon a flat surface, said food and beverage tray comprising:

a tray body defining a lower edge and a recess, said recess having a bottom surface and a support member extending downwardly from said bottom surface;

a center cup receptacle, formed in said tray body forward of said recess, having a downwardly extending cup receptacle wall, said downwardly extending cup receptacle wall extending beyond said lower edge and being configured to be received within an armrest cup holder to pivotally support said food and beverage tray upon said armrest; and a pair of side cup receptacles, each formed in said tray body forward of said recess and each offset form said center cup receptacle, said side cup receptacles each having a sidewall and bottom extending downwardly a distance equal to or less than said lower edge and each having a support extending downwardly from each of said side cup receptacles, said supports and said support member extending downwardly beyond said lower edge to a substantially equal distance to provide support for said food and beverage tray upon a flat surface.

23. The food and beverage tray set forth in claim 22 wherein said support members defines a generally triangular member having its apex extending downwardly.

24. The food and beverage tray set forth in claim 22 wherein said tray body is configured to receiving a substantially identical tray body in a nested arrangement.

* * * * *